US006845818B2

(12) United States Patent
Tutuncu et al.

(10) Patent No.: US 6,845,818 B2
(45) Date of Patent: Jan. 25, 2005

(54) METHOD OF FREEING STUCK DRILL PIPE

(75) Inventors: Azra Nur Tutuncu, Houston, TX (US); Arthur Herman Hale, Angleton, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/425,512

(22) Filed: Apr. 29, 2003

(65) Prior Publication Data

US 2004/0216880 A1 Nov. 4, 2004

(51) Int. Cl.[7] ..... E21B 33/13
(52) U.S. Cl. ..... 166/249; 166/301
(58) Field of Search ..... 166/249, 301, 166/377, 177.1, 177.2

(56) References Cited

U.S. PATENT DOCUMENTS 4,384,625 A 5/1983 Roper et al.
4,561,500 A * 12/1985 Thompson et al. ..... 166/246
4,667,742 A 5/1987 Bodine
5,597,265 A * 1/1997 Gallo ..... 405/128.45
6,009,948 A 1/2000 Flanders et al.
2002/0104652 A1 * 8/2002 Cole et al. ..... 166/249

FOREIGN PATENT DOCUMENTS

JP 2001-43528 * 2/2001
WO 01/83933 A1 8/2001
WO WO 03/050383 * 6/2003 ..... E21B/31/00

* cited by examiner

*Primary Examiner*—William Neuder

(57) ABSTRACT

Disclosed is an auxiliary method for freeing a drill pipe stuck due to build up of filter cake, which provides a reduction in the amount of force required to free said pipe which comprises:

a) Lowering an ultrasonic horn type device down the drill pipe to the point of contact between said drill pipe and mud filter cake;

b) Producing ultrasonic energy at the point of contact until the contact area is sufficiently reduced such that substantially less force is required to free the pipe.

9 Claims, 2 Drawing Sheets

METHOD OF FREEING STUCK DRILL PIPE

FIELD OF THE INVENTION

This invention relates to well servicing and more particularly to a method for the auxiliary use of ultrasonic energy in the case of differential sticking of pipe to reduce the contact area of a filtercake prior to applying freeing force.

BACKGROUND OF THE INVENTION

During the drilling of oil and gas wells, drilling fluid is circulated through the interior of the drill string and then back up to the surface through the annulus between the drill string and the wall of the borehole. The drilling fluid serves various purposes including lubricating the drill bit and pipe, carrying cuttings from the bottom of the well borehole to the rig surface, and imposing a hydrostatic head on the formation being drilled to prevent the escape of oil, gas, or water into the well borehole during drilling operations.

There are numerous possible causes for the drill string to become stuck during drilling. Differential sticking, one of the causes for stuck pipe incidents, usually occurs when drilling permeable formations where borehole pressures are greater than formation pressures. Under those conditions, when the drill pipe remains at rest against the wall of the borehole for enough time, mud filter cake builds up around the pipe. The pressure exerted by drilling fluid will then hold the pipe against the cake wall.

Some warning signs that put one on notice of the possibility of differential sticking are the presence of prognosed low pressure along with depleted sands; long, unstabilized bottom-hole assembly (hereafter BHA) sections in a deviated hole; loss of fluid loss control and increased sand content; and increasing overpull, slack off or torque to start string movement.

Indications of the actual presence of differential sticking include a period of no string movement; the string cannot be rotated or moved, but circulation is unrestricted.

Methods of freeing differentially stuck drill string include applying torque and jar down with maximum torque load; using a spot pipe releasing pill if jarring is unsuccessful; and lowering mud weight, which may have implications with respect to hole stability. The overpull required to release the pipe may exceed rig capacity, and even cause collapse of the rig. It would be very beneficial if a method were available to reduce the required freeing force so that the existing rig would be adequate for overpull without possibly causing collapse.

Application of wave energy in the oil industry is known, however the most common application of ultrasonic energy is cleaning of electronic microchips in the semiconductor industry and daily household cleaning of jewelry.

In addition to the use of acoustic and ultrasonic methods for core measurements in the laboratory, logging, and seismic applications in the field, acoustic energy has been shown by Tutuncu and Sharma to reduce the lift-off pressure of mud filter cakes by a factor of five. See Tutuncu A. N. and Sharma M. M., 1994, "Mechanisms of Colloidal Detachment in a Sonic Field", 1st AIChE International Particle Technology Forum, Paper No 63e, 24–29.

Other uses of ultrasonic energy include supplying the energy through downhole tools into hydrocarbons to facilitate the extraction of the oil from the well by reducing the viscosity of the oil. See, for example, U.S. Pat. Nos. 5,109,922 and 5,344,532. U.S. Pat. No. 5,727,628 discloses the use of ultrasonic to clean water wells.

Freeing pipe using vibrational energy has also been tried in recent years. U.S. Pat. No. 4,913,234 discloses a system for providing vibrational energy to effect the freeing of a section of well pipe which comprises: a) an orbital oscillator including a housing; b) an elongated screw shaped stator mounted in said housing and an elongated screw shaped rotor mounted for precessionally rolling rotation freely in said stator; c) means for suspending said oscillator for rotation within said drill pipe about the longitudinal axis of the drill pipe in close proximity to the stuck portion thereof; and d) drive means for rotatably driving said rotor to effect orbital lateral sonic vibration of said housing such that said housing precesses laterally around the inner wall of said pipe, thereby generating lateral quadrature vibrational forces in said pipe to effect the freeing thereof from said well bore.

U.S. Pat. No. 5,234,056 discloses a method for freeing a drill string which comprises a) resiliently suspending a mechanical oscillator from a support structure on an elastomeric support having a linear constant spring rate; b) coupling said oscillator to the top end of the drill string, the elastomeric support creating a low impedance condition for vibratory energy at said drill string top end; c) driving said oscillator to generate high level sonic vibratory energy in a longitudinal vibration mode so as to effect high longitudinal vibratory displacement of the top end of the drill string; and d) the drill string acting as an acoustic lever which translates the high vibrational displacement at the top end of the drill string into a high vibrational force at the point where the drill string is stuck in the bore hole, thereby facilitating the freeing of the drill string.

Often when a drill pipe is differentially stuck the result is that it has to be cut and the target zone cannot be reached by the optimal route. It would be extremely desirable in the art if a method were available which provided a means of reducing the amount of force required for freeing a stuck drill pipe. Such a method could potentially save enormous amounts of time and money in drilling operations.

In the present invention, it has been discovered that the auxiliary use of ultrasonic energy can help reduce the pipe contact area, thus reducing the required freeing force and often permitting the existing rig to be sufficient for use in the overpull. The present invention will save rig time and prevent sidetracking of the well, a high cost operation especially in offshore deepwater environments.

SUMMARY

In accordance with the foregoing the present invention provides a method for reducing the amount of force necessary to free a stuck drill pipe which comprises an auxiliary method which provides a reduction in the amount of force required to free said pipe.

DETAILED DESCRIPTION OF THE INVENTION

The present invention describes a method of freeing stuck drill pipe, particularly in the case of differential sticking, by the auxiliary use of ultrasonic energy to reduce the amount of freeing force necessary.

Figure 1:
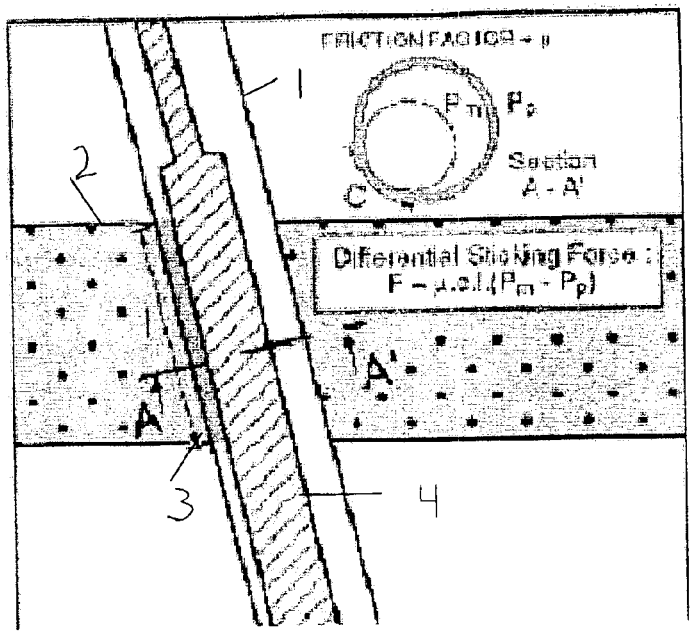
FIG. 1 is a diagram of one possible position of a differentially stuck drill pipe.

FIG. 1 is a diagram representing one example of the position of a differentially stuck drill pipe. The drill string, 4, becomes embedded in filter cake, 3, opposite the permeable zone, 2, at high differential mud pressure overbalance, leading to stuck pipe in the contact zone. Under dynamic circulating conditions, the filter cake is eroded both by hydraulic flow and by the mechanical action of the drill string. When the well is left static with no pipe rotation, a static filter cake may build up, which increases the overall cake thickness. The string may now become embedded in the thick filter cake, particularly when the wellbore, 1, is at high deviation and/or the BHA is not properly stabilized. The static filter cake seals the wellbore pressure (at overbalance) from the backside of the pipe. An area of low pressure develops behind the backside of the string/BHA and starts to equilibrate to the lower formation pressure. A differential pressure starts to build up across the pipe/BHA. With time the area of pipe sealed in the filter cake increases. The overbalance pressure times the contact area provides a drag force that may prevent the pipe from being pulled free. The build-up of the drag force is very rapid from the start and will increase with time.

Typical actions used to free the string include applying torque and jarring down with maximum torque load. Circulation is usually not restricted in the case of differential sticking. Therefore, spotting fluids can be circulated across the zone causing the stuck pipe. Spotting fluids contain additives that can dehydrate and crack filter cakes and additives that can lubricate the drill string. Cracking the filter cake will help to transmit the mud pressure to the backside of the string and remove the differential pressure across the string, resulting in minimization of friction. The sticking force then is reduced by an equivalent amount as shown in Equation 1.

$$F_S = \mu A \Delta P \quad (1)$$

where $\mu$ is the friction coefficient, A is contact area and $\Delta P$ is overbalance. In order to free the pipe the freeing force needs to be equal to or greater than $F_S$. However sometimes it is not possible to generate enough force due to drill string and/or rig limitations, in which case the drill string must be cut, thus causing great financial loss and making it impossible to reach the target zone by the preferred route. Lowering mud weight may be helpful in some cases, but may compromise hole stability.

Design of the drill string is a major consideration. The strength of drill pipe limits the maximum allowable weight and hence the ability to exert overpull. Even if the drill pipe is designed strong enough, the overpull required to release the pipe may exceed rig capacity. It is possible, particularly with small rigs in land operations, for rigs to collapse due to forces applied exceeding the maximum overpull. Downhole jars also allow high impact force to be exerted at the stuck point with relatively low overpull and setdown. However, sometimes the forces exerted are not enough to release the stuck pipe. Jar itself may become stuck as well. In the present invention decrease of contact area of the stuck pipe reduces the amount of overpull required for application. Since A is reduced, sticking force is also reduced (see Equation 1). Hence, the existing difficulties in the release of stuck pipe are minimized.

In the present invention an ultrasonic source is enclosed in a housing of a pipe that permits disposition in the drill string. The ultrasonic source is a high-power sweeping acoustic transducer that operates at either a fixed frequency of approximately 20 KHz, or the frequency can be varied between several Hz and 40 KHz. The tool is made up of a variable number of cylindrical ceramic transducers, which transmit the acoustic energy radially. The transmitter itself is a piece of solid steel to which a piezoelectric driver(s) are attached. The acoustic tool is connected via a normal logging cable to a high power amplifier. The power amplification is related to the ratio of the cross-sectional areas of the tool.

Figure 2:
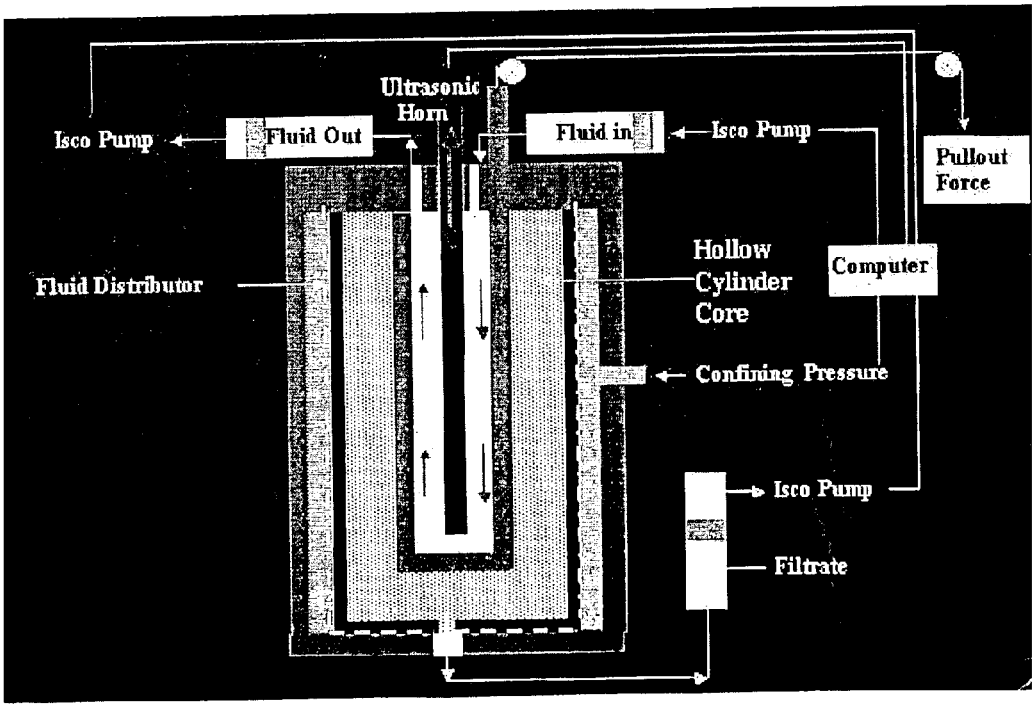
FIG. 2 is a schematic diagram of the hollow cylinder filtration cell used in the experimental work.

To demonstrate the invention, dynamic filtration experiments were conducted with fully brine-saturated Berea sandstone and aloxite hollow cylinder cores with known pore size distribution. FIG. 2 is a schematic drawing of the dynamic hollow cylinder filtration cell used in the experiments. Hollow core tests represent realistic borehole geometry. The cell is designed and built to handle core samples of 4-inch outside diameter (OD) with 8.3-inch length. Variable internal diameters (ID) for hollow cylinder cores can be used in the cell. For this invention, 0.9-inch ID samples were used.

A Digital Sonifier 450 Model by Branson Ultrasonics Corp. of Danbury, Conn. was used for ultrasonic cleaning purposes. The system consists of the power supply unit, the controls, the converter and a horn. A PC was used to interface with the system and to collect the data off the system.

The hollow cylinder Berea cores were first damaged using drilling and/or drill-in fluids of different formulations under various differential pressures. The drill-in fluid was used to conduct the static filtration. The filtration was performed in the cell at 600-psi pressure difference for about 12 hours. The cake thickness was varied between 2 to 3 mm. Drilling fluid was circulated into the hollow cylinder core and out from an annulus at 500-psi circulation pressure and 50 cc/min. Then the pump was stopped and static filtration was initiated at 500 psi long enough to stick a pipe and static filtrate was collected. Then the ultrasonic horn with 20 KHz central frequency was used to apply sonification from the interior of the pipe that stuck to the wall of the core. The permeability, differential pressure, sonification amplitude, power, and temperature were monitored as a function of sonification treatment time, and the energy requirement for near-complete permeability recovery and pullout force were investigated.

The following examples will serve to illustrate the invention disclosed herein. The examples are intended only as a means of illustration and should not be construed as limiting the scope of the invention in any way. Those skilled in the art will recognize many variations that may be made without departing from the spirit of the, disclosed invention.

Experimental Study

Experiments were designed to demonstrate the usefulness of ultrasonic in reducing pullout force for stuck pipe. A special dynamic hollow cylinder circulation device, described above and shown in FIG. 2 was designed for conducting experiments. The cell pressure, temperature, flow rate, applied horn power and the amplitudes were monitored continuously using data acquisition software. The distance between the damaged surface and the horn was varied to study the effect of distance away from the source.

Again referring to FIG. 2, the system comprises a stainless steel cell, two movable pistons, and an ultrasonic horn holder. It is capable of handling in excess of 5,000 psi pressure and also can be operated at elevated temperature under a specified differential pressure. Two syringe pumps (manufactured by and commercially available from ISCO, Inc. of Nebraska) were used to inject fluid and to control the differential pressure simultaneously with a precision of ±1 psi to measure the permeability of the sample. A data acquisition system was used to record and monitor the real-time pressure, flow rate, and volume of fluid injected. During sonification, the real-time amplitude, power, and time were also recorded and monitored.

Figure 3:
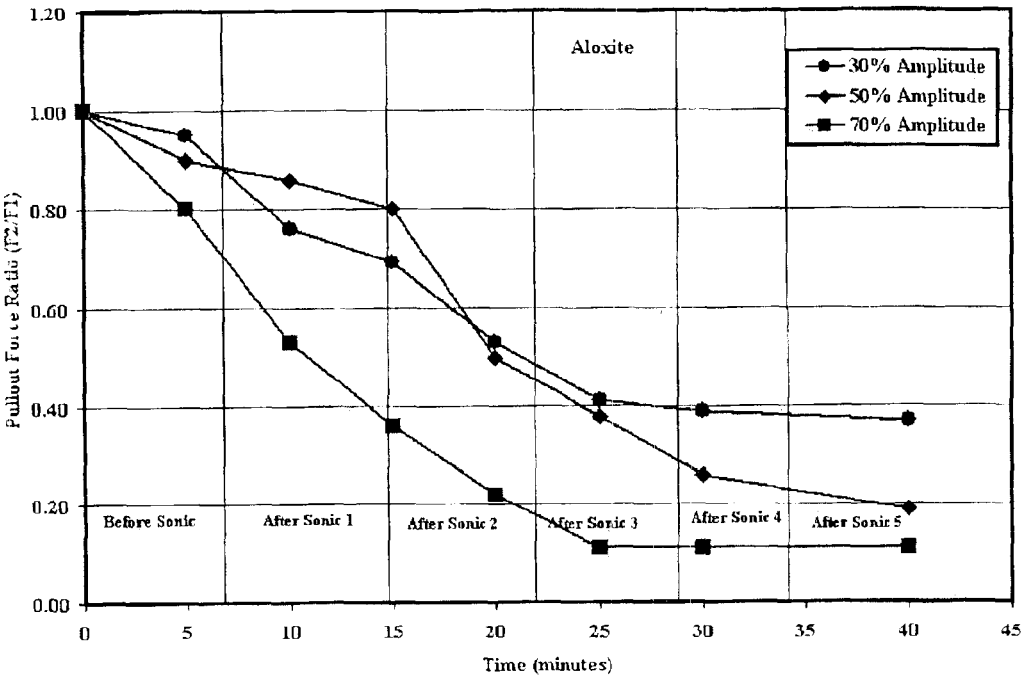
FIG. 3 is a graph showing the reduction in pull out (freeing) force as a function of sonification time for an aloxite hollow cylinder sample damaged by drill-in fluid, where the filter cake was built at an elevated pressure and room temperature.

Hollow cylinder Berea and aloxite core samples with 4" OD, 0.9" ID and 8.3" length were placed in the dynamic hollow cylinder filtration device, and external filter cakes were built by circulating drilling or drill-in fluid under in situ stress conditions between a casing pipe and walls of the hollow cylinder as shown in FIG. 2. Continuous permeability measurements made it possible to observe when the fluid completely plugged the sample pore spaces. Then the ultrasonic horn was placed into the pipe simulating a stuck pipe scenario in the laboratory as shown in FIG. 2. No sonification was applied in the first test. The application of pulling force was initiated and applied to the stuck pipe in gradually increasing magnitude until the pipe was released. The load required to free the pipe was recorded in this case. Then other identical tests were run with the stuck pipe scenarios, but this time sonification was applied for 1, 3, 5, 10, 15, 20, 25, 30 and 35 minute intervals, respectively. After various-time sonifications, a small pulling force was applied and then the force was gradually increased until the pipe was released. The sonifications were repeated at three energy levels (30% amplitude, 50% amplitude, and 70% amplitude). A summary for the aloxite cylinder at various amplitude and sonification times is presented in FIG. 3. FIG. 3 is a graph showing the reduction in pull out (freeing) force as a function of sonification time for an aloxite hollow cylinder sample damaged by drill-in fluid, where the filter cake was built at an elevated pressure and room temperature. The pullout force ratio is the ratio of freeing force after sonification to freeing force before sonification.

Figure 4:
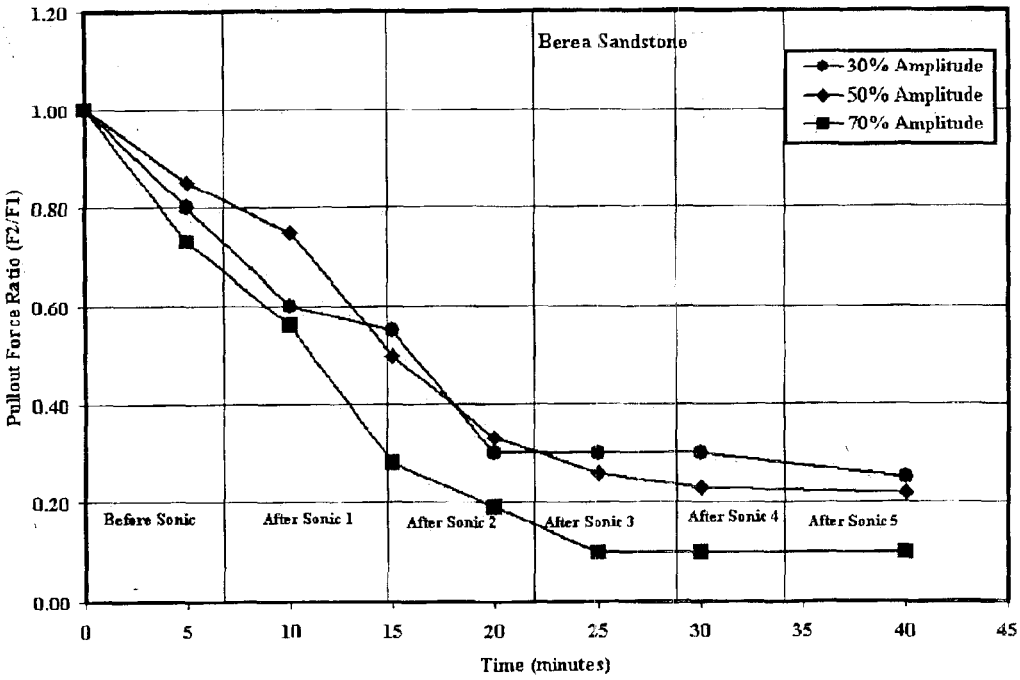
FIG. 4 is a graph showing the reduction in pull out (freeing) force as a function of sonification time for a Berea sandstone hollow cylinder sample.

The fastest reduction in the freeing force was observed when 70% (highest power) was applied; however, any amplitude level and timing of sonification helped reduce the freeing force compared to the case of no sonification. The results for Berea hollow cylinder cores are shown in FIG. 4. Different samples were used to test the effect of increasing sonification time. For all the tests except the 40-minute sonification test, a pulling force was applied to free the pipe. However, the longer the sonification time, the smaller was the magnitude of the required force. And, finally, for 40-minute sonification, no pulling force was needed; the release was instantaneous after the sonification. The test results were explained by reduction in the contact area. Because sonification reduced the thickness of the filter cake, it resulted in a reduction in the contact area. Therefore, from equation (1), $F_S=\mu A \Delta P$, $\mu$ and $\Delta P$ are kept constant, A is smaller, hence $F_S$ is smaller. A summary of the pullout force ratios for aloxite and Berea hollow cylinder samples is shown in FIGS. 3 and 4.

We claim:

1. In any method of freeing a drill pipe stuck due to build up of filter cake, the auxiliary method which provides a reduction in the amount of force required to free said pipe, which comprises:

a) lowering an ultrasonic horn down the drill pipe to a point of contact between said drill pipe and filter cake;

b) applying ultrasonic energy at the point of contact until the contact area is sufficiently reduced that substantially less force is required to free the pipe.

2. The method of claim 1 further comprising the pipe is differentially stuck.

3. The method of claim 1 further comprising the ultrasonic energy is applied at the point of contact so that at least one ultrasonic wave is directed substantially perpendicular to the filter cake.

4. The method of claim 1 wherein the ultrasonic energy is applied at a varying frequency in the range of 20 kHz to 40 kHz.

5. The method of claim 1 wherein the ultrasonic energy is appied at a varying frequency in the range of about 20±5 kHz.

6. The method of claim 1 wherein the ultrasonic energy is applied at a fixed frequency of about 20 KHz.

7. The method of claim 1 wherein the ultrasonic energy is applied in a power amplitude in the range of 50 wafts to 450 watts.

8. The method of claim 7 wherein the ultrasonic energy is applied in a power amplitude in the range of 100 watts to 250 watts.

9. The method of claim 8 wherein the ultrasonic energy is applied in a power amplitude is less than 200 watts.

* * * * *